US008047859B2

(12) United States Patent
Chang

(10) Patent No.: US 8,047,859 B2
(45) Date of Patent: Nov. 1, 2011

(54) USB PLUG PROTECTIVE COVER

(75) Inventor: Cheng-Lung Chang, Tu-Cheng (TW)

(73) Assignee: Chi Mei Communications Systems, Inc., Tu-Cheng, New Taipei (TW)

( * ) Notice: Subject to any disclaimer, the term of this patent is extended or adjusted under 35 U.S.C. 154(b) by 132 days.

(21) Appl. No.: 12/575,871

(22) Filed: Oct. 8, 2009

(65) Prior Publication Data

US 2010/0151712 A1 Jun. 17, 2010

(30) Foreign Application Priority Data

Dec. 16, 2008 (CN) ..... 2008 1 0306285

(51) Int. Cl.
*H01R 13/44* (2006.01)

(52) U.S. Cl. ..... 439/135; 439/357

(58) Field of Classification Search ..... 439/135, 439/136, 148, 353, 357
See application file for complete search history.

(56) References Cited

U.S. PATENT DOCUMENTS

| | | | | |
|---|---|---|---|---|
| 6,522,534 | B1 * | 2/2003 | Wu | 361/679.4 |
| 7,241,153 | B2 * | 7/2007 | He et al. | 439/148 |
| 7,341,464 | B2 * | 3/2008 | Cuellar et al. | 439/135 |
| 7,503,780 | B1 * | 3/2009 | Huang | 439/135 |
| 7,558,069 | B2 * | 7/2009 | Chung | 361/737 |

* cited by examiner

*Primary Examiner* — Thanh Tam Le
(74) *Attorney, Agent, or Firm* — Altis Law Group, Inc.

(57) ABSTRACT

A USB Plug protective cover configured for detachably covering a USB plug connector of an electronic device includes a base cover and an elastic piece. The base cover includes a covering end, the covering end defines an accommodating cavity recessed therein configured for accommodating the USB Plug therein. The elastic piece is assembled to the base cover and accommodated within the accommodating cavity. The elastic piece detachably latches with the USB plug connector to prevent the USB protective cover from loosening or separating from the USB plug connector.

17 Claims, 5 Drawing Sheets

USB PLUG PROTECTIVE COVER

BACKGROUND

1. Technical Field

The exemplary disclosure relates generally to protective cover structures, more particularly, to an universal serial bus (USB) Plug protective cover configured for protecting the USB Plug from contamination.

2. Description of Related Art

Universal serial bus (USB) plug connectors are widespread used in a great variety of electronic devices such as computers, notebooks, keyboards, portable memory devices etc. to fulfill the data transmission between electronic devices. Typically, an unprotected USB plug will be inserted into a USB jack that is often at least partially within and protected by the electronic device. When the USB plug connectors are not in use, the small-sized substances such as dust, moisture, etc. are prone to attach or enter into the interior of the USB plug connectors. Thus the utility of such USB plug connectors is affected by the possible contaminations.

In an effort to overcome this difficulty, a variety of protective covers have been introduced to provide a form of protection against the affection of substances. Such approaches provide hinged and sliding mechanical doors as well as removable covers and caps. While providing some degree of protection, known arrangements for attempting the provision of protection are overly complex and prone to failure. Many of the known arrangements have to be manipulated by the user for opening, closing, covering or uncovering before or after insertion of the plug into the connector. In those embodiments where caps or covers are used the caps and covers are prone to being loosen or lost by the user.

Therefore, there is room for improvement within the art.

BRIEF DESCRIPTION OF THE DRAWINGS

Many aspects of the exemplary USB Plug protective cover can be better understood with reference to the following drawings. These drawings are not necessarily drawn to scale, the emphasis instead being placed upon clearly illustrating the principles of the present USB Plug protective cover. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
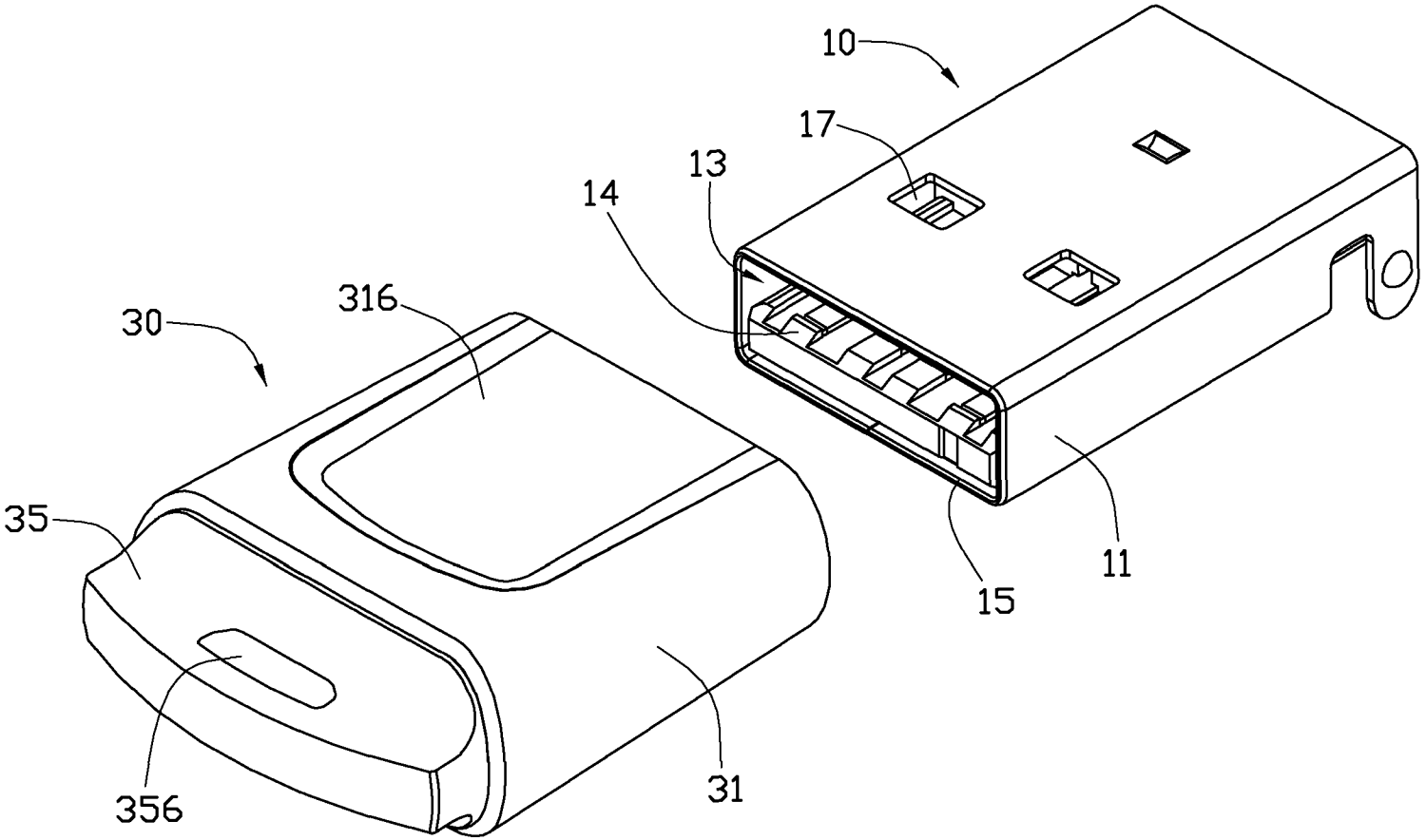
FIG. 1 shows a perspective view of a USB Plug protective cover detached from a USB plug connector according to an exemplary embodiment.

FIG. 1 shows an exemplary USB Plug protective cover 30 detached from a USB plug connector 10. The USB plug connector 10 includes a substantially rectangular connector end 11. The connector end 11 includes a connecting port 13 and a connecting peripheral wall 15 surrounding the connecting port 13. The connecting port 13 is a substantially rectangular cavity recessed in the connector end 11, and includes several electric connecting terminals 14 disposed therein. The connecting peripheral wall 15 is a substantially rectangular frame, and defines two spaced rectangular latching holes 17 therethrough.

Figure 2:
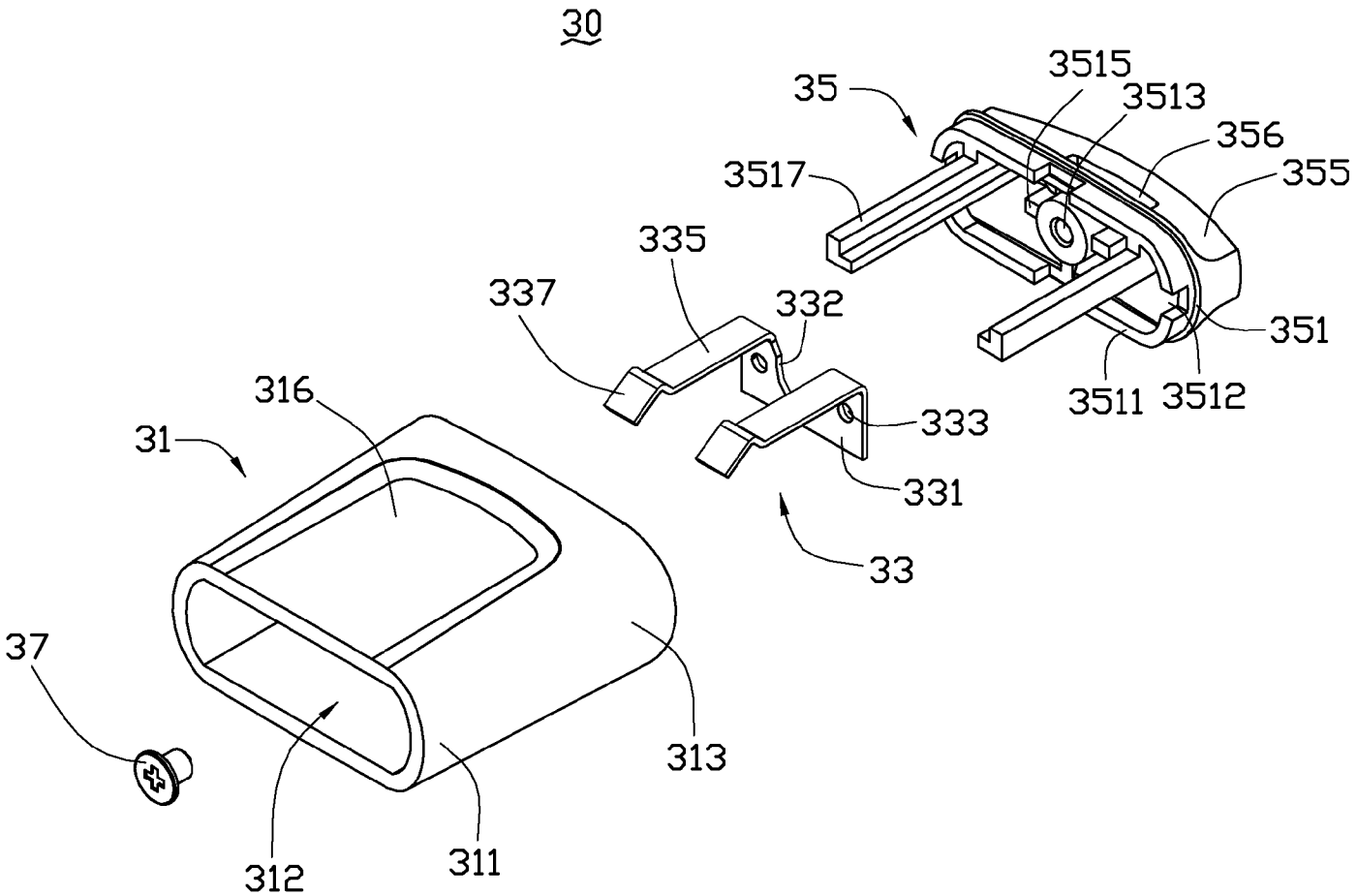
FIG. 2 shows a disassembled perspective view of the USB Plug protective cover shown in FIG. 1.
Figure 3:
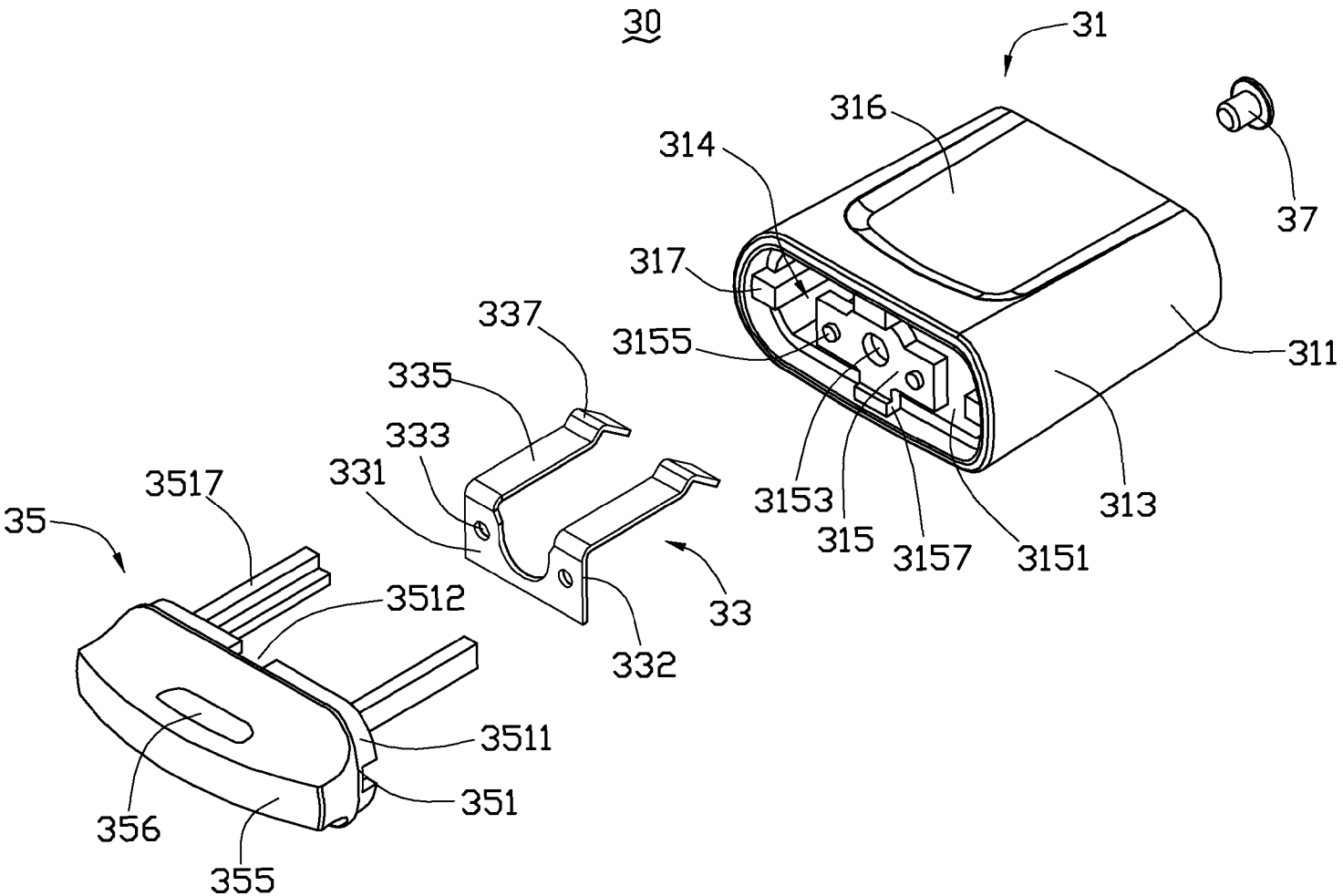
FIG. 3 is similar to FIG. 2, but viewed from another aspect.

Also referring to FIG. 2 and FIG. 3, the USB protective cover 30 is configured for detachably covering the USB plug connector 10 of the electronic device. The USB protective cover 30 includes a base cover 31, an elastic piece 33, an end cover 35 and a fixing piece 37. The base cover 31 includes a covering end 311 and a releasing end 313 opposite to the covering end 311. The covering end 311 of the base cover 31 defines an accommodating cavity 312 recessed therein toward the opposite releasing end 313. The accommodating cavity 312 is configured for enveloping the USB plug connector 10 therein. At least one recess 316 in an outer surface of the base cover 31 allows for easier manual manipulation of the cover 30.

The releasing end 313 of the base cover 31 defines a substantially annular shaped assembling cavity 314 recessed therein toward the covering end 311. The assembling cavity 314 has a end wall 315. The two opposite ends of the end wall 315 defines two connecting holes 3151 therethrough communicating with the accommodating cavity 312 respectively. Two guiding bars 317 are disposed at the two opposite inner walls of the base cover 31 and configured to penetrate through the corresponding two connecting holes 3151 respectively. The two ends of the guiding bars 317 are accommodated within the assembling cavity 314 and the accommodating cavity 312 of the base cover 31 respectively. The middle portion of the end wall 315 defines a circular assembling through hole 3153 therethrough and two cylindrical posts 3155 protruding therefrom and positioned at the two sides of the assembling through hole 3153. The two sides of the end wall 315 adjacent to the inner wall of the assembling cavity 314 each defines a latching block 3157 protruding therefrom respectively.

The elastic piece 33 is a sheet assembled within the base cover 31. The elastic piece 33 includes a main portion 331 and at least one elastic arm 335 extending and substantially perpendicularly bent from the main portion 331. In the exemplary embodiment, the main portion 331 is a substantially U-shaped metal sheet mounted on the end wall 315 of the assembling cavity 314 and held between the end cover 35 and the end wall 315 of the base cover 31. The main portion 331 includes two fixing portions 332 and two through holes 333 defined through the two fixing portions 332 respectively corresponding to the two cylindrical posts 3155 of the base cover 31. Two elastic arms 335 extend and bend from the end of the two cylindrical posts 3155 respectively and are perpendicular to the main portion 331. The distal end of the elastic arm 335 is bent thereby forming a substantially V-shaped latching portion 337. The latching portion 337 is configured to be latched within the corresponding rectangular latching hole 17 of the USB plug connector 10.

The end cover 35 is mounted on the releasing end 313 of the base cover 31 and includes an assembling end 351 and an opposite hanging end 355. The circumference of assembling end 351 defines a substantially annular frame shaped assembling wall 3511 extending therefrom corresponding to the size and shape of the assembling cavity 314 of the base cover 31. The assembling wall 3511 defines four gaps 3512 therethrough corresponding to the two latching blocks 3157 and the two guiding bars 317 respectively. The middle portion of the cross section of the assembling end 351 defines a screwed hole 3513 therethrough corresponding to the circular assembling through hole 3153 of the middle portion of the end wall 315, and two resisting blocks 3515 disposed adjacent to the two sides of the screwed hole 3513 corresponding to the two cylindrical posts 3155 of the base cover 31. The two sides of the cross section of the assembling end 351 further defines two assembling bars 3517 protruding therefrom configured for penetrating through the two connecting holes 3151 of the base cover 31. In the present embodiment, the length of the assembling bar 3517 is longer than the length of the elastic arm 335 of the elastic piece 33 but shorter than the length of the base cover 31, so as to avoid the elastic arm 335 resisting on the USB plug connector 10. The hanging end 355 defines a hanging hole 356 therethrough for a rope or chain, etc.

The fixing piece 37 is a screw configured to fix the end cover 35 with base cover 31.

In assembly, the two elastic arms 335 of the elastic piece 33 penetrate through the corresponding two connecting holes 3151 respectively and are accommodated within the accommodating cavity 312 of the base cover 31. The main portion 331 resists on the end wall 315 of the assembling cavity 314 and the two cylindrical posts 3155 of the bottom 3155 penetrates through the corresponding two through holes 333 of the two fixing portions 332 of the elastic piece 33 respectively. The assembling end 351 of the end cover 35 is inserted into the assembling cavity 314 of the releasing end 313 of base cover 31. The two assembling bars 3517 of the attaching cover 35 penetrate through the corresponding two connecting holes 3151 of the base cover 31 respectively along the two guiding bars 317 and are partially accommodated within the accommodating cavity 312. The two guiding bars 317 and the two latching blocks 3157 latch into the corresponding four gaps 3512 of the assembling wall 3511 of the end cover 35 respectively. The two resisting blocks 3515 of the end cover 35 tightly resist on the two cylindrical posts 3155 of the base cover 31 respectively. The fixing piece 37 penetrated through the circular assembling through hole 3153 of the base cover 31 and the elastic piece 33, and is fixedly screwed with the screwed hole 3513 of the end cover 35.

Figure 4:
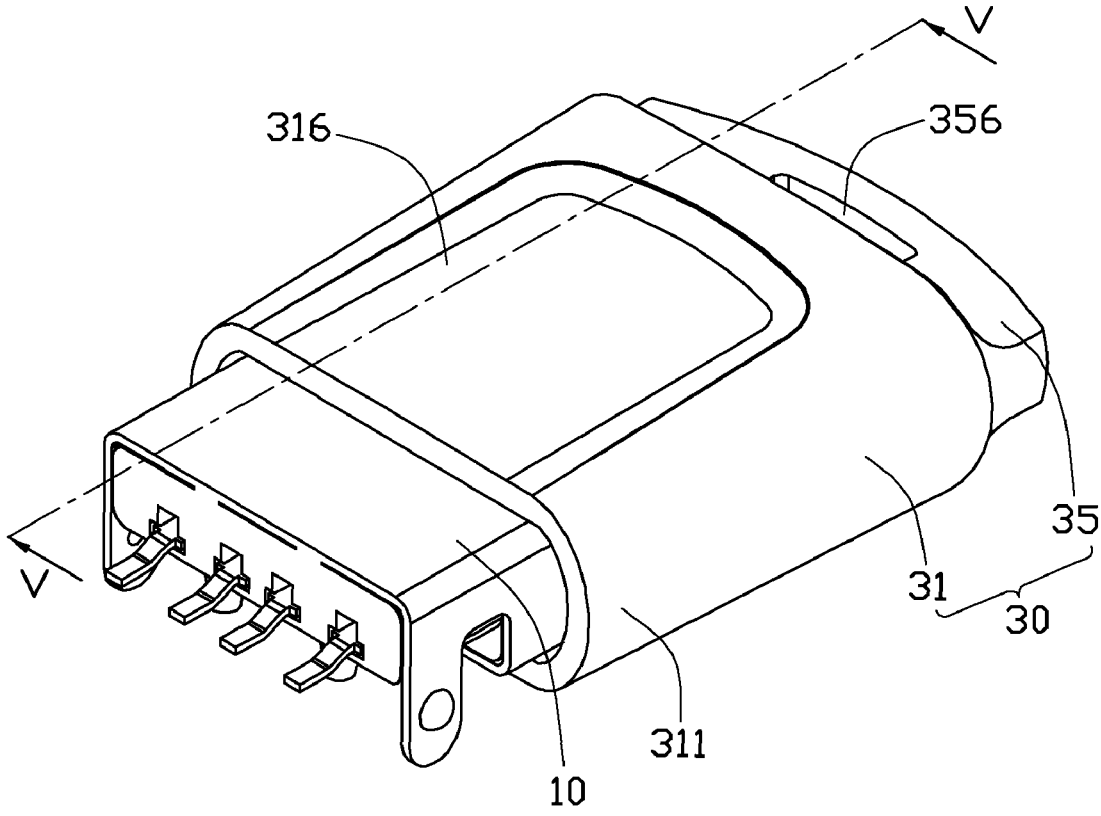
FIG. 4 shows a perspective view of the USB Plug protective cover mounted on the USB plug connector.
Figure 5:
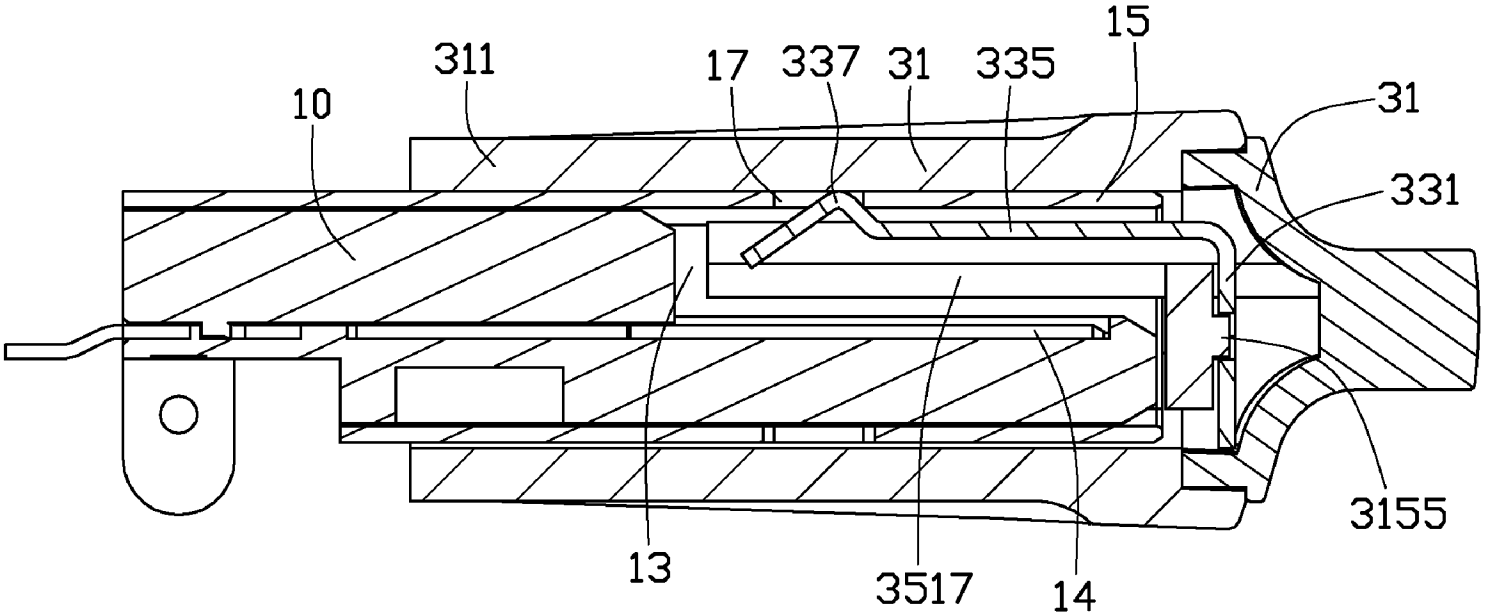
FIG. 5 shows a cross-sectional view taken along line V-V of FIG. 4.

Also referring to FIG. 4 and FIG. 5, the connector end 11 of the USB plug connector 10 is inserted into and accommodated within the accommodating cavity 312 of the USB protective cover 30. Meanwhile, the elastic piece 33 is inserted into the connecting port 13 of the USB plug connector 10, with the two latching portions 337 latch within the corresponding two rectangular latching holes 17 respectively, to prevent the USB protective cover 30 from loosening or separating from the USB plug connector 10.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A USB Plug protective cover configured for detachably covering a USB plug connector of an electronic device, comprising:

a base cover comprising a covering end and a releasing end opposite to the covering end, the covering end defining an accommodating cavity for accommodating the USB Plug therein, the releasing end defines an assembling cavity at the releasing end that partially communicates with the accommodating cavity, an end wall formed in the assembling cavity, the end wall defining two connecting holes therethrough communicating with the accommodating cavity respectively; and an elastic piece assembled to the base cover and accommodated within the accommodating cavity; wherein, the elastic piece detachably latches with the USB plug connector to prevent the USB protective cover from loosening or separating from the USB plug connector.

2. The USB Plug protective cover as claimed in claim 1, wherein the USB plug connector includes a connecting port, a peripheral wall surrounding the connecting port and two latching holes spaced defined through the peripheral wall; the elastic piece includes a main portion and two elastic arms; the main portion is mounted on the end wall and accommodated within the assembling cavity, the two elastic arms penetrate through the end wall and latch with the two latching holes respectively.

3. The USB Plug protective cover as claimed in claim 1, wherein the base cover further includes two guiding bars protrude from two opposite inner walls thereof, the two guiding bars penetrate through the two connecting holes respectively and the two ends of the guiding bars are accommodated within the assembling cavity and the accommodating cavity respectively.

4. The USB Plug protective cover as claimed in claim 3, wherein the USB Plug protective cover further includes an end cover mounted on the releasing end of the base cover; the end cover includes an assembling end assembled within the assembling cavity of the base cover for resisting the main portion of the elastic piece; and an opposite hanging end defining a hole therethrough.

5. The USB Plug protective cover as claimed in claim 4, wherein the end wall defines an assembling through hole, the USB Plug protective cover further includes a fixing piece configured to penetrate through the assembling through hole of the end wall and fix to the assembling end of the end cover.

6. The USB Plug protective cover as claimed in claim 4, wherein the end wall defines two posts protruding therefrom, the main portion of the elastic piece is a substantially U-shaped metal sheet and includes two fixing portion, the two fixing portion define two through holes therethrough corresponding to the two posts of the base cover.

7. The USB Plug protective cover as claimed in claim 5, wherein the assembling end of the end cover further defines two assembling bars protruding therefrom configured for penetrating through the two connecting holes of the base cover along the two guiding bars respectively.

8. The USB Plug protective cover as claimed in claim 7, wherein the two sides of the end wall adjacent to the inner wall of the assembling cavity each defines a latching block protruding therefrom respectively; the circumference of assembling end defines an annular frame shaped assembling wall extending therefrom configured for being assembled within the assembling cavity; the assembling wall defines four gaps therethrough configured for latching with the two latching blocks and the two guiding bars respectively.

9. The USB Plug protective cover as claimed in claim 1, wherein the base cover further includes at least one recess in an outer surface of the base cover.

10. The USB Plug protective cover as claimed in claim 2, wherein the latching portion is V-shaped disposed at the distal end of the elastic arm.

11. A USB Plug protective cover configured for detachably covering a USB plug connector of an electronic device, comprising:

a base cover comprising a covering end and an end wall, the covering end defining an accommodating cavity for accommodating the USB Plug therein, the end wall defining two connecting holes therethrough communicating with the accommodating cavity respectively; and an elastic piece assembled within the accommodating cavity of the base cover and configured for detachably latching with the USB plug connector;

an end cover mounted on the base cover, the end cover defining two assembling bars protruding therefrom configured for penetrating through the two connecting holes of the base cover;

wherein, the USB plug connector comprises two spaced latching holes defined through the peripheral wall thereof; the elastic piece comprises two latching portions at the distal end thereof for latching with the two latching holes of the USB plug connector respectively.

12. The USB Plug protective cover as claimed in claim 11, wherein the base cover further includes a releasing end opposite to the covering end and defines an assembling cavity at the releasing end that partially communicates with the accommodating cavity; the end cover includes an assembling end assembled within the assembling cavity of the base cover and an opposite hanging end defining a hole therethrough.

13. The USB Plug protective cover as claimed in claim 12, wherein the base cover further includes at least one recess in an outer surface of the base cover.

14. The USB Plug protective cover as claimed in claim 12, wherein the elastic piece includes a main portion and two elastic arms; the main portion is mounted on the end wall and accommodated within the assembling cavity, the two elastic arms penetrate through the end wall and latch with the two latching holes respectively.

15. The USB Plug protective cover as claimed in claim 14, the end wall defines two posts protruding therefrom, the main portion of the elastic piece is a substantially U-shaped metal sheet and includes two fixing portion, the two fixing portion define two through holes therethrough corresponding to the two posts of the base cover.

16. The USB Plug protective cover as claimed in claim 11, wherein the base cover further includes two guiding bars protrude from two opposite inner walls thereof, the two guiding bars penetrate through the two connecting holes respectively to guide the assembling bars.

17. The USB Plug protective cover as claimed in claim 11, further comprising a fixing piece, wherein the end wall defines an assembling through hole, the fixing piece is configured to penetrate through the assembling through hole of the end wall and fix to the end cover.

* * * * *